US008186365B2

(12) United States Patent
Kang

(10) Patent No.: US 8,186,365 B2
(45) Date of Patent: May 29, 2012

(54) COSMETIC CASE

(76) Inventor: Sun-Ah Kang, Uiwang-si (KR)

( * ) Notice: Subject to any disclaimer, the term of this patent is extended or adjusted under 35 U.S.C. 154(b) by 267 days.

(21) Appl. No.: 12/523,157

(22) PCT Filed: Dec. 7, 2007

(86) PCT No.: PCT/KR2007/006353
§ 371 (c)(1),
(2), (4) Date: Jul. 14, 2009

(87) PCT Pub. No.: WO2008/088127
PCT Pub. Date: Jul. 24, 2008

(65) Prior Publication Data

US 2010/0101600 A1 Apr. 29, 2010

(30) Foreign Application Priority Data

Jan. 15, 2007 (KR) ..... 10-2007-0004221

(51) Int. Cl.
*A45D 33/02* (2006.01)

(52) U.S. Cl. ..... 132/299

(58) Field of Classification Search ..... 132/299–300, 132/303, 306–307; 222/321.2, 321.7
See application file for complete search history.

(56) References Cited

U.S. PATENT DOCUMENTS

| | | | | |
|---|---|---|---|---|
| 1,866,576 | A * | 7/1932 | Neiman | 132/299 |
| 2,105,621 | A * | 1/1938 | Testi | 401/28 |
| 2,594,641 | A * | 4/1952 | Griffith et al. | 137/543 |
| 4,747,419 | A * | 5/1988 | Flynn et al. | 132/73 |
| 5,876,139 | A * | 3/1999 | De Laforcade | 401/190 |
| 6,363,948 | B2 * | 4/2002 | Choi | 132/313 |
| 6,688,795 | B1 * | 2/2004 | Jacob et al. | 401/207 |
| 7,101,107 | B1 * | 9/2006 | Byun | 401/286 |
| 2001/0031171 | A1 * | 10/2001 | Delage | 401/205 |
| 2003/0161675 | A1 * | 8/2003 | Lee | 401/200 |
| 2004/0120753 | A1 * | 6/2004 | Gieux | 401/200 |
| 2006/0201528 | A1 | 9/2006 | Lee | |
| 2007/0110509 | A1 * | 5/2007 | Dumler | 401/291 |

FOREIGN PATENT DOCUMENTS

| | | | |
|---|---|---|---|
| KR | 100602426 | | 7/2006 |
| KR | 100647455 | | 11/2006 |
| KR | 100647455 | B1 * | 11/2006 |
| KR | 10060094771 | | 3/2007 |

* cited by examiner

*Primary Examiner* — Todd Manahan
*Assistant Examiner* — Jennifer Gill
(74) *Attorney, Agent, or Firm* — IPLA P.A.; James E. Bame

(57) ABSTRACT

Disclosed herein is a cosmetic case. The cosmetic case opens a discharge port of a main body by a support unit that is pushed backwards when a puff is pressed, and closes the discharge port when the puff is released, thus stopping discharging powder. The cosmetic case for containing powder is constructed so that a control unit controls the discharge of powder to the puff, using the simple support unit having thin legs, thus allowing the powder to be discharged only when necessary. Further, the cosmetic case has the simple support unit, so that the manufacture and assembly of the cosmetic case is easy, and the smooth flow of powder is permitted, and has no part in which the powder may be caught or accumulated, thus allowing the support unit to perform an excellent support function for a lengthy period of time.

9 Claims, 4 Drawing Sheets

[Fig. 1]
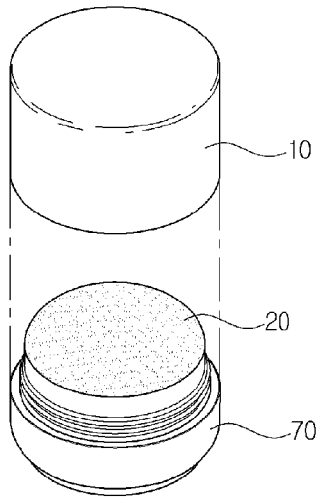
[Fig. 2]
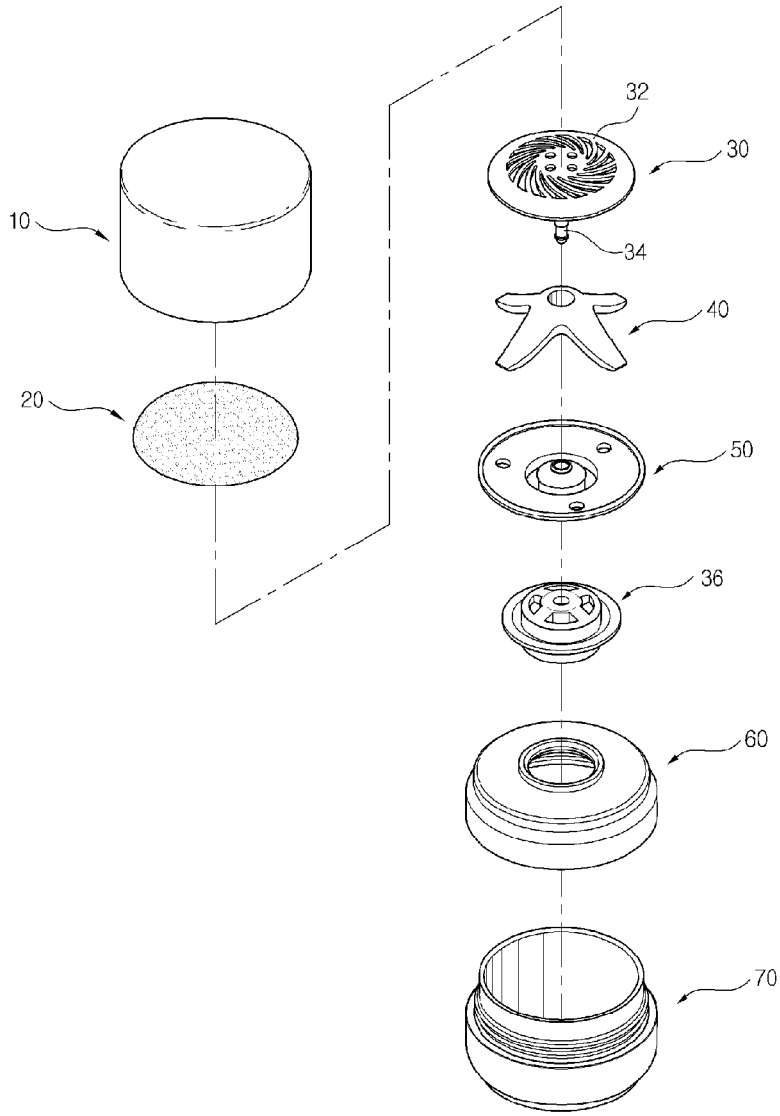

[Fig. 3]
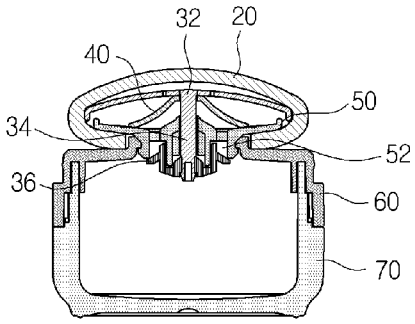
[Fig. 4]
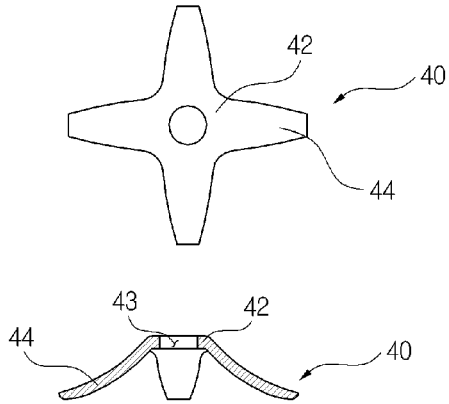
[Fig. 5]
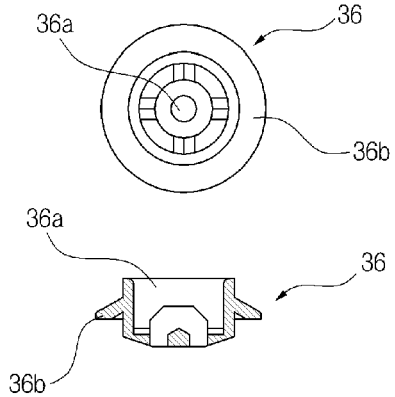
[Fig. 6]
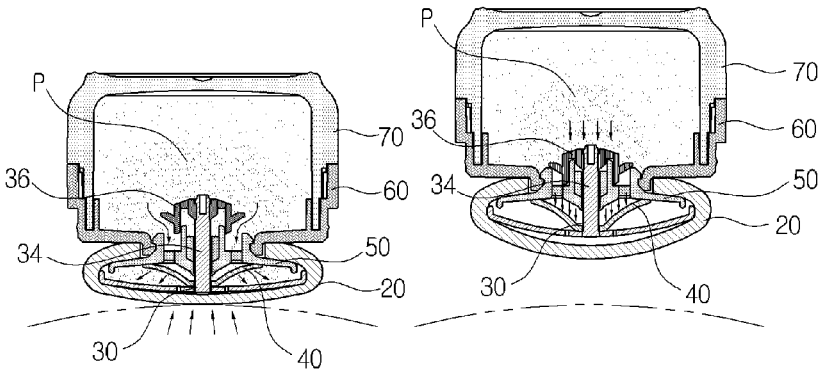

[Fig. 7]
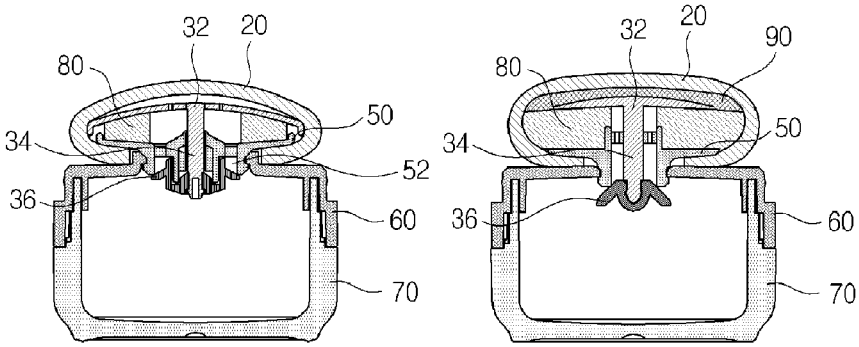
[Fig. 8]
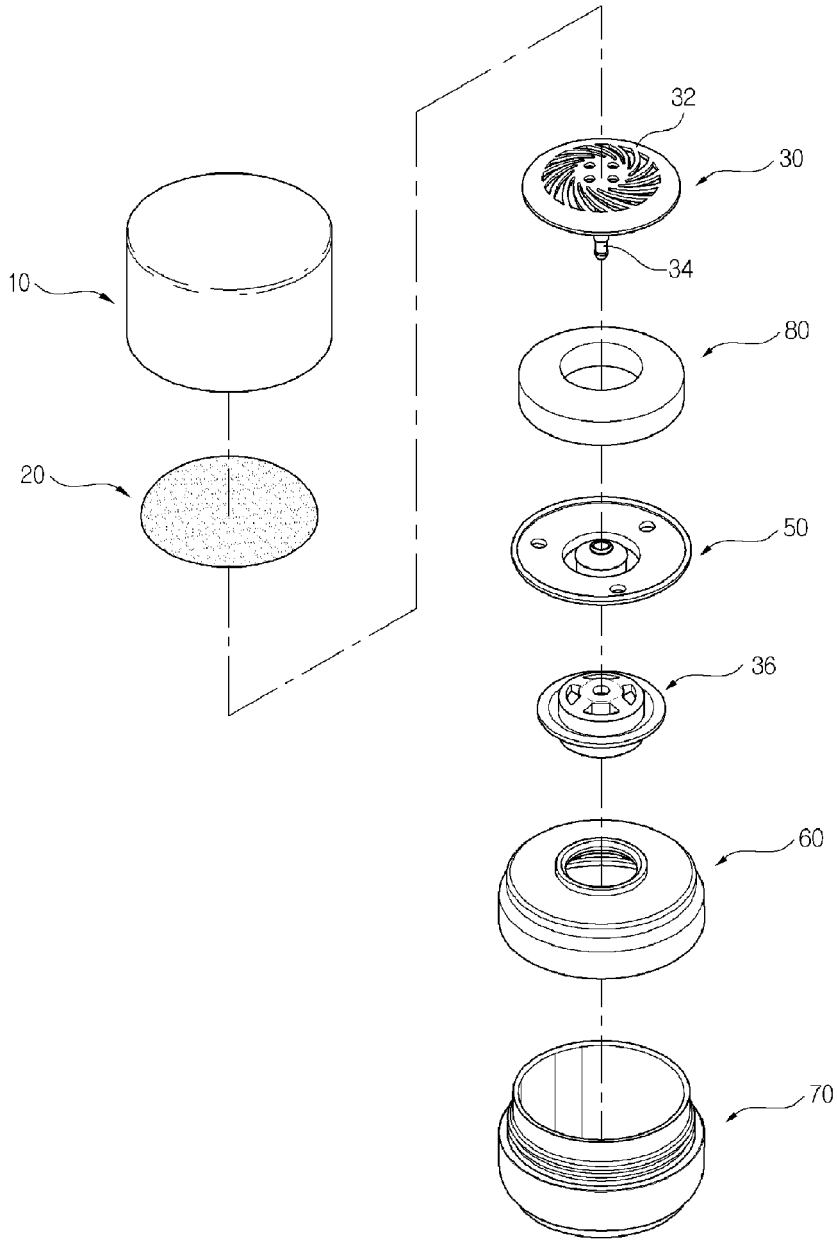

[Fig. 9]
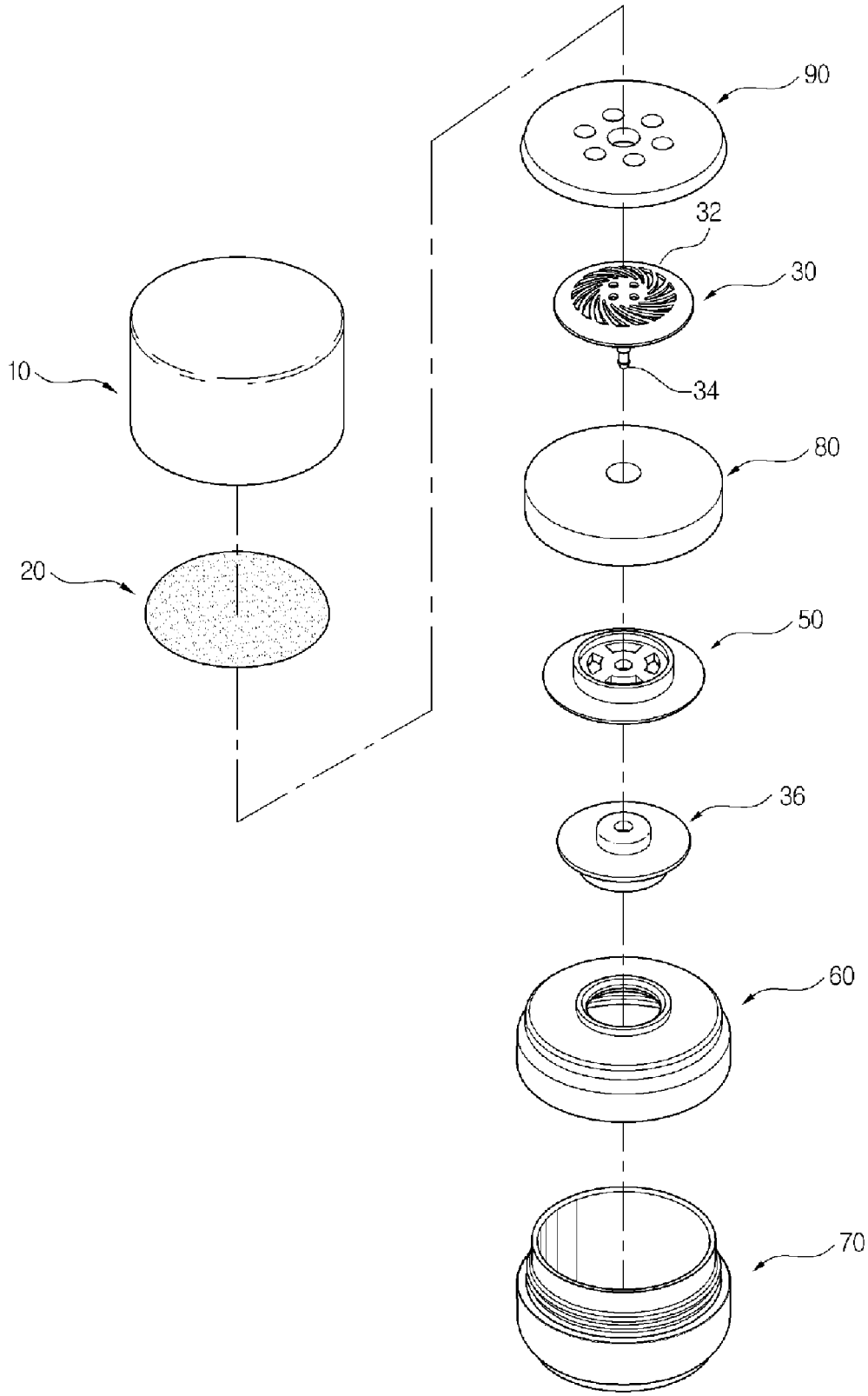

COSMETIC CASE

TECHNICAL FIELD

The present invention relates, in general, to a cosmetic case which discharges powder from a main body through a puff and, more particularly, to a cosmetic powder case, which opens a discharge port of a main body by a support unit that is pushed backwards when a puff is pressed, and closes the discharge port when the puff is released, thus stopping discharging powder.

BACKGROUND ART

Generally, cosmetic powder, which is used in makeup, especially in colored makeup, is applied to a user's face by covering powder stored in a powder case with an additional puff and dabbing the face with the puff.

Such a makeup method requires the additional puff. Further, when the puff is covered with the powder, the powder may disperse, thus making the surrounding area dirty, and the loss of the powder may occur. Since the powder case is held with one hand and the puff is held with the other hand, both hands must be used during applying makeup. Thus, it is complicated to apply makeup, and it takes a long time to apply makeup.

In order to overcome the drawbacks of the conventional powder makeup method, a new cosmetic case has been proposed and used, which is constructed so that a puff is integrated with a main body of the cosmetic case into a single structure. The cosmetic case will be described below with reference to FIG. 1.

FIG. 1 is a view showing the conventional cosmetic powder case. Referring to FIG. 1, the conventional cosmetic case integrated with the puff is constructed so that powder stored in the main body is discharged by dabbing at the face with the puff 20 installed in the main body 70. Thus, the cosmetic case allows a user to rapidly and easily apply makeup, compared to the conventional method requiring the additional puff.

However, since the main body 70 is always open toward the puff 20, the powder may be undesirably discharged to the outside. Moreover, when the cosmetic case is turned upside down, an excessive amount of powder may be instantaneously discharged to the puff 20, so that the powder may clump.

That is, the conventional cosmetic case is problematic in that the puff 20 always contacts the powder, so that the discharged amount of the powder may be uneven, and in addition, may be considerably reduced, when the powder is accumulated in the puff 20.

In order to solve the problems, a cosmetic case having a movable cover has been proposed. Further, in order to support the movable cover, the cosmetic case is provided with a spring and an elastic deforming part. The movable cover causes powder to be discharged to a puff only when a user puts on makeup. Meanwhile, when the powder is not in use, the cover is closed. However, the conventional spring or elastic deforming part has a complex shape, such as a coil shape or a spiral shape, so that it is complicated to manufacture or assemble the cosmetic case. Further, when the powder is caught in the spring or the elastic deforming part, the compression and tension of the spring or elastic deforming part is hindered, so that the performance of the cover is lowered.

Thus, there is a demand for a new cosmetic powder case, which is constructed so that the discharge of powder is controlled by the movement of a cover, and which opens or closes the cover using a simpler and firmer structure, thus preventing the powder from being caught in the cover due to repeated use of the cosmetic case, therefore preventing the performance of the cover from being lowered.

DISCLOSURE OF INVENTION

Technical Problem

Accordingly, the present invention has been made keeping in mind the above problems occurring in the prior art, and an object of the present invention is to provide a cosmetic case, which is constructed so that a control unit controls the discharge of powder to a puff, using a simple support unit having thin legs.

Another object of the present invention is to provide a cosmetic case, which simplifies the construction of a support unit so as to prevent powder from being caught in the support unit, therefore allowing the cosmetic case to have superior performance for a lengthy period of time.

Technical Solution

In order to accomplish the objects, the present invention provides a cosmetic case, including a main body which contains contents therein, a cover unit which is provided on an upper portion of the main body, with a discharge port formed in a central portion of the cover unit, a control unit which is coupled to the cover unit in such a way that an upper end of the control unit is positioned above the cover unit and functions to open or close the discharge port, and a support unit which is provided under the control unit and upwardly biases and supports the control unit, wherein the control unit includes a contact part which has a discharge hole so that the contents are discharged from the main body, a guide which is provided on a center of a bottom of the contact part in such a way as to extend long and is inserted into the discharge port, and a closure part which is coupled to a lower end of the guide, and is formed to close a lower portion of the discharge port.

The support unit is made of an elastic material.

The support unit is positioned under the control unit and above the cover unit, and includes a guide coupling part which is provided on the support unit so that the guide of the control unit is inserted into the guide coupling part, and a leg which extends outwards from the guide coupling part and is inclined downwards. The leg contacts an upper surface of the cover unit, thus causing the guide coupling part to be spaced apart from the cover unit, and the guide coupling part supports a lower end of the control unit.

The closure part includes a guide support part which is secured to the lower end of the guide, and a wing which extends outwards from the guide support part in such a way as to be inclined downwards.

The cover unit further includes a subsidiary cover part which is coupled to an inside edge of the discharge port and extends upwards, with a hole formed in the subsidiary cover part. The closure part closes a lower portion of the hole of the subsidiary cover part.

The leg comprises two or more legs provided on an outer portion of the guide coupling part, and an empty space having no leg is defined between neighboring legs.

The cosmetic case further includes a puff surrounding both the contact part and the subsidiary cover part.

The support unit is positioned under the control unit and above the cover unit, and includes a hole which is formed in the support unit so that the guide of the control unit is inserted into the hole, and a support part which surrounds an outside portion of the hole, thus defining a ring-shaped edge. The support part contacts an upper surface of the cover unit, thus causing the guide coupling part to be spaced apart from the cover unit, and the guide coupling part supports a lower end of the control unit.

The support part comprises a three-dimensional structure having a predetermined thickness.

The support part is made of a material having excellent shape restoring capacity, such as sponge, latex, or synthetic resin.

The cosmetic case further comprises an upper soft part covering a top of the support unit and a top of the control unit, wherein the upper soft part is formed such that the upper soft part has a predetermined thickness and a circumferential edge of the upper soft part corresponds to a circumferential edge of the support part, and the upper soft part and the support unit are positioned above and under the contact part, respectively, and the circumferential edge of the upper soft part or of the support part is longer than a circumferential edge of the contact part, for attachment of an edge of a lower surface of the upper soft part to an edge of an upper surface of the support part.

The upper soft part is made of a material having excellent shape restoring capacity, such as sponge, latex, or synthetic resin.

The upper soft part comprises a three-dimensional structure having a predetermined thickness.

The upper soft part comprises a jet hole for discharging contents from the main body.

Advantageous Effects

As described above, the present invention provides a cosmetic case for containing powder, which is constructed so that a control unit controls the discharge of powder to a puff, using a simple support unit having thin legs, thus allowing the powder to be discharged only when necessary.

Further, the present invention provides a cosmetic case, which has a simple support unit, so that the manufacture and assembly of the cosmetic case is easy, and the smooth flow of powder is permitted, and which has no part in which the powder may be caught or accumulated, thus allowing the support unit to perform an excellent support function for a lengthy period of time.

BRIEF DESCRIPTION OF THE DRAWINGS

FIG. 1 is a view showing a conventional cosmetic powder case;

FIG. 2 is an exploded view showing a cosmetic powder case, according to an embodiment of the present invention;

FIG. 3 is a sectional view showing the cosmetic powder case, according to the present invention;

FIG. 4 is a view illustrating a support unit of the cosmetic powder case according to the present invention in a plan view and a side sectional view;

FIG. 5 is a view illustrating a closure part of the cosmetic powder case according to the present invention in a plan view and a side sectional view;

FIG. 6 is a view showing the state in which a puff of the cosmetic powder case according to the present invention is pressed and used and a view showing the state after the cosmetic powder case according to the present invention has been used;

FIG. 7 is a sectional view showing a cosmetic powder case, according to another embodiment of the present invention; and FIGS. 8 and 9 are an exploded view showing the cosmetic powder case, according to another embodiment of the present invention.

BEST MODE FOR CARRYING OUT THE INVENTION

The above and other objects, features and advantages of the present invention will be more clearly understood from the following detailed description taken in conjunction with the accompanying drawings. A cosmetic case according to the preferred embodiment of the present invention is provided with a simple support unit, so that the manufacture and assembly of the cosmetic case is easy, the flow of powder is smooth, and has no part in which the powder is caught or accumulated, thus allowing an excellent support function to be performed for a lengthy period of time.

FIG. 2 is an exploded view showing a cosmetic powder case, according to an embodiment of the present invention. Referring to FIG. 2, the external appearance of the cosmetic case is defined by a main body 70 and a cap 10 that covers the upper portion of the main body. Other parts are installed in a space defined by the main body and the cap.

A main cover part 60 is coupled to the upper portion of the main body 70, and a subsidiary cover part 50 is placed on the main cover part 60. A control unit 30 is placed on a support unit 40 to be supported by the support unit 40. A closure part 36 is coupled to a guide 34 which is provided on the lower portion of the control unit 30. A contact part 32 of the control unit is covered with a puff 20.

The main body 70 contains powder therein, and is open at the top thereof. The main cover part 60 may be manufactured separately from the main body 70 and be coupled to the upper portion of the main body. Alternatively, the main cover part may be integrated with the main body 70 into a single structure.

A discharge port is formed in the central portion of the main cover part 60. The subsidiary cover part 50 may be additionally coupled to the discharge port. The main cover part 60 and the subsidiary cover part 50 constitute a cover unit. The closure part 36, which is coupled to the control unit 30, is located under the discharge port of the main cover part 60. The closure part 36 is formed to have a larger sectional area than that of the discharge port, thus closing the lower portion of the discharge port. When the subsidiary cover part 50 is additionally provided to the cosmetic case, the closure part is formed to close a hole 52 which is formed in the subsidiary cover part 50.

The subsidiary cover part 50 is coupled to the main cover part to surround the edge of the discharge port of the main cover part 60, and extends obliquely upwards, like a funnel. The upward extending portion of the subsidiary cover part seals the edge of the discharge port, and supports the puff 20, thus preventing the powder from being discharged to parts other than the puff 20.

The control unit 30 has on the top thereof the contact part 32 which has a plurality of holes. The guide 34 is provided at the center on the bottom of the control unit in such a way as to extend long downwards. The contact part 32 is formed to have a curved surface which is similar to a hemisphere. The guide 34 has the shape of a long rod. Consequently, the control unit has an umbrella shape. The guide 34 passes through the cover unit in such a way as to extend into the main body 70.

The closure part 36 is coupled to the lower end of the guide 34, and functions to close the hole of the subsidiary cover part 50 or the discharge port of the main cover part 60.

The support unit 40 is provided under the control unit 30 so as to prevent the contact part 32 of the control unit 30 from coming into contact with the subsidiary cover part 50 or the main cover part 60. The control unit 30 is located above the cover unit to be spaced apart from the cover unit by a predetermined interval, by the support unit. Thus, when the control unit 30 is spaced apart from the cover unit, and the closure part 36 is located at the uppermost position, the closure part closes the hole or the discharge port. The support unit 40 is made of an elastic material, and has legs which extend radially outwards, like a starfish. Each leg is inclined downwards.

The puff 20 covers the contact part 32, and the edge of the puff is supported by the edge of the subsidiary cover part 50. When the subsidiary cover part 50 is not provided, the puff surrounds the outer portion of the main cover part 60.

FIG. 3 is a sectional view showing the cosmetic powder case, according to the present invention. Referring to FIG. 3, the support unit 34 has the shape of a peak, and supports the control unit 30 so that it does not contact the subsidiary cover part 50. The closure part 36, which is coupled to the lower end of the control unit 30 provided at an upper position, comes into close contact with the lower end of the hole 52, and thus closes the hole. The puff 20 surrounds both the contact part 32 and the edge of the subsidiary cover part 50.

FIG. 4 is a view illustrating the support unit according to the present invention in a plan view and a side sectional view. Referring to FIG. 4, a guide coupling part 42 is provided on the central portion of the support unit 40 so that the guide 34 is coupled to the support unit. The legs 44 extend outwards from the guide coupling part 42. A guide insert hole 43 is formed in the guide coupling part 42 so that the guide 34 is inserted into the guide insert hole.

As shown in the plan view, the legs 44 are provided around the guide coupling part 42 at regular intervals, so that a space permitting the passage of the powder is defined between the legs 44. Further, as shown in the side sectional view, the legs 44 are inclined downwards from the guide coupling part 42. Thereby, the guide coupling part 42 has a predetermined height from the lower end of each leg 44.

Such a support unit 40 has a simple shape, so that it is easy to manufacture and assemble the support unit, it allows smooth flow of the powder, and it has no part in which the powder may be caught and accumulated. Thus, the support unit can perform an excellent support function for a lengthy period of time.

FIG. 5 is a view illustrating the closure part according to the present invention in a plan view and a side sectional view. Referring to FIG. 5, the closure part 36 functions to close the lower portion of the hole of the subsidiary cover part 50 or the lower portion of the discharge port of the main cover part 60. While the control unit 30 moves downwards or upwards, the closure part 35 opens or closes the feeding channel of the powder.

The closure part 36 is formed to be slightly larger than the discharge port or the hole, thus reliably closing the discharge port or the hole. A guide support part **36*a* is provided on the central portion of the closure part so as to support the guide 34. A wing 36*b* is provided on the outer edge of the closure part. The wing 36*b*** is formed to contact the edge of the discharge port or the hole.

The wing **36*b* extends to be inclined downwards. Thus, the upper portion of the wing 36*b* is inserted into the discharge port or the hole, and the wing 36*b* is in closer contact with the edge of the discharge port or the hole. As described above, the wing 36*b* is formed obliquely. Thus, by positioning the closure part 36 slightly above the junction of the closure part and the edge of the discharge port or the hole, the oblique wing 36*b* is in closer contact with the edge of the discharge port or the hole. Moreover, the wing 36*b*** is formed obliquely, so that little part of the powder channel is covered, thus allowing the powder to be smoothly discharged.

FIG. 6 is a view showing the state in which the puff of the cosmetic powder case according to the present invention is pressed and used, and a view showing the state after the cosmetic powder case according to the present invention has been used. Referring to FIG. 6, when the puff 20 of the cosmetic powder case according to the present invention contacts a user's skin and is pressed, the legs 44 of the support unit 40 are pressed, and the control unit 30 moves inwards. Thereby, the closure part 36 moves inwards, so that the main body is opened. At this time, the powder P flows downwards through the space between the legs 44 of the support unit 40, and contacts the skin through the puff 20.

As the cosmetic case moves away from the skin, the legs 44 push up the control unit 30 due to the elasticity of the support unit 40. Simultaneously, the closure part 36 closes the main body 70 so that the powder P does not flow to the puff 20 any more.

Mode for the Invention

Meanwhile, the cosmetic case which is constructed as described above may be variously embodied. The present invention will be described in detail with reference to various embodiments which are shown in the accompanying drawings.

FIG. 7 is a sectional view showing a cosmetic powder case, according to another embodiment of the present invention, and FIGS. 8 and 9 are an exploded view showing the cosmetic powder case, according to another embodiment of the present invention. Referring to FIGS. 7, 8 and 9, the cosmetic powder case may be provided with a ring-shaped support unit 80 which is made of an elastic material, such as sponge, synthetic resin, or latex. Most preferably, the support unit is made of a latex material.

The support unit 80 serves to bias a control unit 30 upwards by a predetermined height. Further, when external pressure acts on the support unit, the support unit is compressed due to its inherent characteristics. At this time, a control unit 30 is moved, so that a closure part 36 opens a hole 52. Thereby, powder can be discharged through a hole which is formed in the support unit 80. Meanwhile, when the external pressure is removed, the support unit 80 made of sponge, synthetic resin, or latex restores its original shape due to the characteristics of the material of the support unit. At this time, the support unit pushes up the control unit 30, and the closure part 36 closes the hole 52.

The cosmetic case may include an upper soft part 90, which is made of a material having high elasticity, such as sponge, synthetic resin, or latex, and covers the top of the support unit 80 and the top of the control unit. Most preferably, the upper soft part is made of a latex material.

The circumferential edge of a support part of the support unit 80 is longer than the circumferential edge of the subsidiary cover part 50, so that the support unit 80 can be placed on the subsidiary cover part 50.

The circumferential edge of the upper soft part 90 corresponds to the circumferential edge of the support part of the support unit 80. The upper soft part 90 is a three-dimensional structure having a predetermined thickness. Preferably, a plurality of jet holes is formed in the surface of the upper soft part 90 so that the contents are discharged from the main body 70 through the hole 52 of the subsidiary cover part and the hole of the support unit 80.

The upper soft part 90 and the support unit 80 are positioned above and under the contact part 32, respectively. The circumferential edge of the upper soft part 90 or of the support part of the support unit 80 is longer than the circumferential edge of the contact part 32. Thus, while the contact part 32 is disposed between the support unit 80 and the upper soft part 90, the edge of the lower surface of the upper soft part 90 is attached to the edge of the upper surface of the support part.

The puff 20 is placed so that it covers the upper soft part 90 and the support unit 80. Since the upper soft part 90, which is made of a material having high elasticity, is provided inside the puff 20, a user feels a soft sensation when the puff 20 of the cosmetic case is in contact with and pressed against the user's skin.

The invention claimed is:

1. A cosmetic case, comprising:

a main body containing contents therein;

a cover unit provided on an upper portion of the main body, with a discharge port formed in a central portion of the cover unit;

a control unit coupled to the cover unit for opening or closing the discharge port; and a support unit provided under the control unit, and upwardly biasing and supporting the control unit, wherein the control unit comprises:

a contact part having a discharge hole so that the contents are discharged from the main body;

a guide extending from a center of a bottom of the contact part and inserted into the discharge port; and a closure part coupled to a lower end of the guide, and formed to close a lower portion of the discharge port with elasticity of the support unit when the support unit is free of pressing force from the contact part and to open the lower portion of the discharge port when the support unit is pressed from the contact part, wherein the contact part of the control unit is positioned above the cover unit, wherein the closure part comprises:

a guide support part to be secured to the lower end of the guide; and a wing extending outwards from the guide support part in such a way as to be inclined downwards.

2. The cosmetic case according to claim 1, wherein the support unit is positioned under the control unit and above the cover unit, and comprises:

a guide coupling part provided on the support unit so that the guide of the control unit is inserted into the guide coupling part; and a leg extending outwards from the guide coupling part, and inclined downwards, the leg contacting an upper surface of the cover unit, and causing the guide coupling part to be spaced apart from the cover unit, and the guide coupling part supporting a lower end of the control unit.

3. The cosmetic case according to claim 1, wherein the cover unit further comprises a subsidiary cover part which is coupled to an inside edge of the discharge port and extends upwards, with a hole formed in the subsidiary cover part, and the closure part closes a lower portion of the hole of the subsidiary cover part.

4. The cosmetic case according to claim 3, further comprising: a puff surrounding both the contact part and the subsidiary cover part.

5. The cosmetic case according to claim 1, wherein the support unit is positioned under the control unit and above the cover unit, and comprises:

a hole formed in the support unit so that the guide of the control unit is inserted into the hole; and a support part surrounding an outside portion of the hole, thus defining a ring-shaped edge, the support part contacting an upper surface of the cover unit, and causing a guide coupling part to be spaced apart from the cover unit, and the guide coupling part supporting a lower end of the control unit.

6. The cosmetic case according to claim 5, wherein the support part is made of a material having shape restoring capacity.

7. The cosmetic case according to claim 5, further comprising:

an upper soft part covering a top of the support unit and a top of the control unit, wherein the upper soft part is formed such that the upper soft part has a predetermined thickness and a circumferential edge of the upper soft part corresponds to a circumferential edge of the support part, and the upper soft part and the support unit are positioned above and under the contact part, respectively, and the circumferential edge of the upper soft part or of the support part is longer than a circumferential edge of the contact part, for attachment of an edge of a lower surface of the upper soft part to an edge of an upper surface of the support part.

8. The cosmetic case according to claim 7, wherein the upper soft part is made of a material having shape restoring capacity.

9. The cosmetic case according to claim 7, wherein the upper soft part comprises a jet hole for discharging contents from the main body.

* * * * *